US005889872A

United States Patent [19]

Sooriakumar et al.

[11] Patent Number: 5,889,872

[45] Date of Patent: Mar. 30, 1999

[54] CAPACITIVE MICROPHONE AND METHOD THEREFOR

[75] Inventors: Kathirgamasundaram Sooriakumar, Scottsdale; Daniel J. Koch, Mesa; Kenneth G. Goldman, Chandler, all of Ariz.

[73] Assignee: Motorola, Inc., Schaumburg, Ill.

[21] Appl. No.: 674,382

[22] Filed: Jul. 2, 1996

[51] Int. Cl.[6] ..... H04R 25/00

[52] U.S. Cl. ..... 381/174; 381/191; 437/209

[58] Field of Search ..... 381/113, 116, 381/168, 174, 191, 173; 437/209; 367/181; 310/324

[56] References Cited

U.S. PATENT DOCUMENTS 5,188,983 2/1993 Guckel et al. ..... 437/209
5,452,268 9/1995 Bernstein ..... 381/174

OTHER PUBLICATIONS

J. Bernstein et al., "Advanced Micromachined Condenser Hydrophone", Solid–State Sensor and Actuator Workshop, Hilton Head, South Carolina, Jun. 1994, pp. 73–77.

J. Bernstein, "A Micromachined Condenser Hydrophone", 1992 IEEE, pp. 161–165.

J. Bergqvist et al., "A Silicon Condenser Microphone with a Highly Perforated Backplate", 1991 IEEE, pp. 266–269.

J. Kung et al., "An Integrated Air–Gap–Capacitor Pressure Sensor and Digital Readout with Sub–100 Attofarad Resolution", Journal of Microelectromechanical Systems, vol. 1, No. 3, Sep. 1992, pp. 121–129.

*Primary Examiner*—Huyen Le
*Attorney, Agent, or Firm*—Robert F. Hightower

[57] ABSTRACT

A capacitive microphone (10) utilizes a polysilicon diaphragm (14) that overlies an atmospheric cavity (34). The diaphragm is doped and annealed to form a sensitivity of the microphone (10). A silicon cap covers and protects the diaphragm (14) and a fixed plate (18).

11 Claims, 2 Drawing Sheets

CAPACITIVE MICROPHONE AND METHOD THEREFOR

BACKGROUND OF THE INVENTION

The present invention relates, in general, to condenser microphones, and more particularly, to a condenser microphone formed with semiconductor processing techniques.

In the past, a variety of techniques were utilized to form condenser or capacitive microphones on silicon substrates. Typically, a cavity is etched into a silicon substrate in order to form a thin single crystal silicon diaphragm that functions as one plate of a capacitor. The second capacitor plate typically is formed as a metal layer overlying the diaphragm. Because the diaphragm is formed by etching a cavity in a silicon substrate, it is difficult to control the thickness of the diaphragm therefore difficult to control the diaphragm stiffness and the resulting sensitivity of the microphone.

Often the spacing between the plates of the capacitor generally are established by the thickness of a photoresist layer. Because photoresist can not be exposed to high (above 150 degrees Celsius) temperatures, standard semiconductor deposition techniques can not be used for the fixed plate. Additionally, the fixed capacitor plate often is formed either by electroplating a metal overlying the diaphragm, or by wafer bonding techniques. Electroplating is not compatible with standard semiconductor processing techniques because electroplating can result in intermetallic diffusions and other contaminants that can not be integrated into the manufacturing flow thereby increasing microphone costs. Because it is difficult to control diaphragm thicknesses, stress, and plate spacing resulting from wafer bonding, it is also difficult to control the sensitivity of microphones utilizing wafer bonding techniques.

Additionally, many of the prior art techniques utilized temperatures that were in excess of what can be tolerated by semiconductor circuits or else resulted in forming active semiconductor devices spaced laterally from the capacitor thereby resulting in a large semiconductor die size and increased costs.

Accordingly, it is desirable to have a capacitive microphone and method therefor that results in an easily manufactured and low cost capacitive microphone, that has well controlled sensitivity, that has well controlled diaphragm stiffness, that has well controlled diaphragm capacitor plate spacing, that includes integrated active semiconductor devices, and that has a small die size.

DETAILED DESCRIPTION OF THE DRAWINGS

Figure 1:
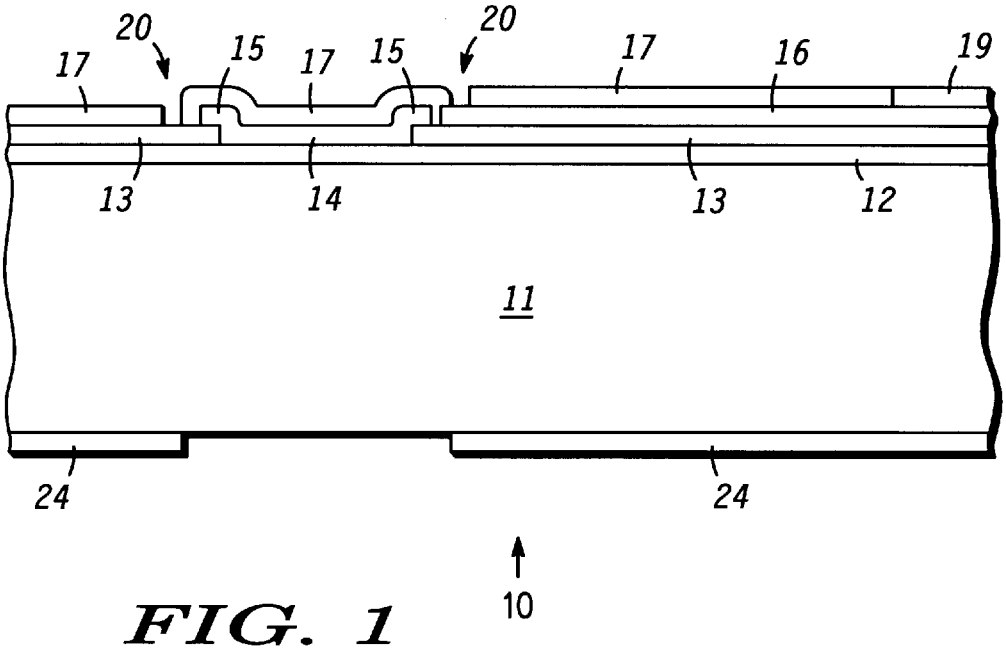
FIG. 1 illustrates an enlarged cross-sectional portion of a capacitive microphone at a stage of manufacturing in accordance with the present invention.

FIG. 1 illustrates an enlarged cross-sectional portion of a capacitive microphone 10 at a stage of manufacturing. Microphone 10 includes a silicon substrate 11 in which an atmospheric cavity will subsequently be formed as will be seen hereinafter. A field oxide layer 12 is formed on substrate 11 and will subsequently be utilized as an etch stop when forming the atmospheric cavity. Layer 12 also isolates the capacitor structure of microphone 10 from substrate 11. A silicon nitride layer 13 is formed on layer 12 and then patterned to provide an opening that exposes a portion of layer 12 where a diaphragm 14 will subsequently be formed. Layer 13 also functions to protect layer 12 during future removal of a sacrificial layer as will be seen hereinafter.

Diaphragm 14 is formed by applying a first polysilicon layer on silicon nitride layer 13 including the opening formed in silicon nitride layer 13. The first polysilicon layer is patterned and etched to form diaphragm 14 within the opening of layer 13, and integral tabs 15 extending over the edge of layer 13. Tabs 15 will subsequently be used to form an electrical connection to diaphragm 14. Because the thickness of a polysilicon layer can be well controlled by semiconductor manufacturing techniques, it is easy to control the thickness of diaphragm 14. Typically, diaphragm 14 has a thickness between approximately one to two microns in order to assist in controlling the sensitivity of microphone 10. The sensitivity control is established through the correlation between diaphragm thickness and the deflection caused by an incident acoustic wave front. Another portion of the first polysilicon layer is used to form a polysilicon connection runner 16 that will subsequently be utilized to form electrical connection to a second capacitor plate of microphone 10. Runner 16 extends behind tab 15 of diaphragm 14 and does not make electrical connection to diaphragm 14. Because FIG. 1 is a cross-section and is not shown in three dimensions, it may erroneously appear as though runner 16 contacts diaphragm 14 and tab 15. It should be noted that another runner (not shown) similar to runner 16 connects to tab 15 to provide electrical connection to diaphragm 14.

A phospho-silicate glass layer 17 is formed over exposed portions of layer 13, diaphragm 14, tabs 15, and runner 16. Layer 17 is used as a first sacrificial layer to establish the distance between diaphragm 14 and a fixed capacitor plate of microphone 10 as will be seen hereinafter. The thickness of layer 17 establishes the spacing of the capacitor plates and thereby assists in establishing the capacitance of microphone 10. Because the thickness of layer 17 can be accurately controlled by semiconductor processing techniques, the plate spacing and capacitance can also be accurately controlled. The specific capacitance is used to establish a roll-off frequency above which the sensitivity of microphone 10 degrades rapidly. For example, for a roll-off frequency of approximately of twenty KHz, layer 17 has a thickness between four and five microns. It will be noted that the roll-off frequency is also controlled by other parameters as will be explained hereinafter.

Holes 20 are formed in layer 17 in order to expose portions of layer 13 so that a subsequently formed top capacitor plate can be attached to layer 13 as will be seen hereinafter. Additionally, holes 20 allow the subsequently formed capacitor plate to form electrical contact to runner 16 as will also be seen hereinafter. Also, a distal portion of layer 17 is removed to allow for forming an electrical contact to runner 16 as will be seen hereinafter.

Figure 2:
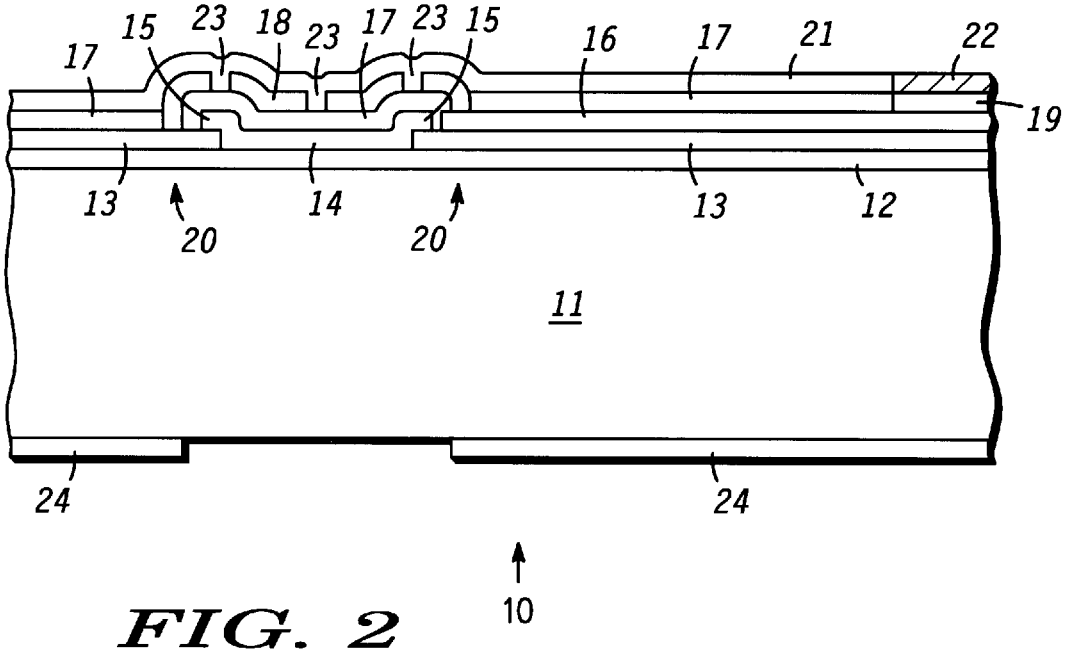
FIGS. 2 and 3 illustrate the microphone of FIG. 1 at subsequent manufacturing stages in accordance with the present invention.

FIG. 2 illustrates microphone 10 at a subsequent manufacturing stage. Elements of FIG. 2 having the same reference numerals as FIG. 1 are the same as the corresponding FIG. 1 elements. A second polysilicon layer is applied and patterned to form a fixed capacitor plate 18. The second polysilicon layer is applied to cover layer 17, fill holes 20, and also cover the portion of runner 16 exposed where layer 17 has been removed to form an electrical contact 19. The second polysilicon layer is then patterned and etched to leave the second polysilicon layer filling holes 20 and overlying diaphragm 14. Additionally, a portion of the second polysilicon layer is left to form electrical contact 19 on layer 16. During this etching or patterning process, damping holes 23 are formed in fixed capacitor plate 18. Holes 23 function to control the damping of diaphragm 14 during operation thereby assisting in establishing the roll-off frequency of microphone 10. Typically, the roll-off frequency is established around twenty KHz (20 KHz) with a substantially flat frequency response at lower frequencies.

Thereafter, a second phospho-silicate glass layer 21 is formed covering both layer 17 and plate 18 but is omitted from contact 19. Layer 21 functions as an additional sacrificial layer and as a doping layer for plate 18 and will subsequently be removed as will be seen hereinafter.

The stress or stiffness or tension of diaphragm 14 and plate 18 is established by both doping diaphragm 14 and plate 18, and by performing a rapid thermal anneal (RTA) of diaphragm 14 and plate 18. Without establishing the stress, diaphragm 14 and plate 18 may bow or distort thereby changing the sensitivity of microphone 10. Doping of diaphragm 14 and plate 18 is performed by heating microphone 10 to drive phosphorous dopants from layer 17 into diaphragm 14, and from layers 17 and 21 into plate 18. For example, for a two micron thick diaphragm 14 dopants are driven in to establish a resistivity of approximately fifteen ohms/sq. and a doping concentration of approximately $1\times10^{18}$ to $1\times10^{21}$ atoms/cm$^3$. The doping generally is performed by heating microphone 10 to a temperature between 800 and 1,100 degrees Celsius for a time between one and ten hours. It is important that the resistance of diaphragm 14 and plate 18 not be too high in order to prevent the RC time constant of diaphragm 14 and of plate 18 from affecting the performance of microphone 10. Consequently, the resistivity of diaphragm 14 and plate 18 typically is between ten and one thousand ohms/sq and generally is approximately fifteen ohms/sq.

Diaphragm 14 and plate 18 are further subjected to a rapid thermal anneal (RTA) to further reduce the tension or stiffness or stress of diaphragm 14 and plate 18. The RTA generally is performed by subjecting diaphragm 14 to temperatures of approximately 950 to 1300 degrees Celsius for a time of at least fifteen seconds in order to relax the crystalline structure of diaphragm 14 and plate 18. After the RTA, the sensitivity of the capacitor formed by diaphragm 14 and plate 18 generally is between approximately 0.1 and 20 mv/pascal.

A mask 24 is applied to a bottom or back side of substrate 11 and will subsequently be used for etching an atmospheric opening through substrate 11 as will be seen hereinafter in the discussion of FIG. 4. Preferably mask 24 is silicon nitride although it may be an oxide of silicon or may be silicon nitride with an underlying silicon oxide layer. A contact electrode 22 is deposited on contact 19 in order to form electrical contact to runner 16 thereby forming electrical contact to plate 18. It should be noted that mask 24 could also be formed at the step of forming layer 13 as described in FIG. 1.

Figure 3:
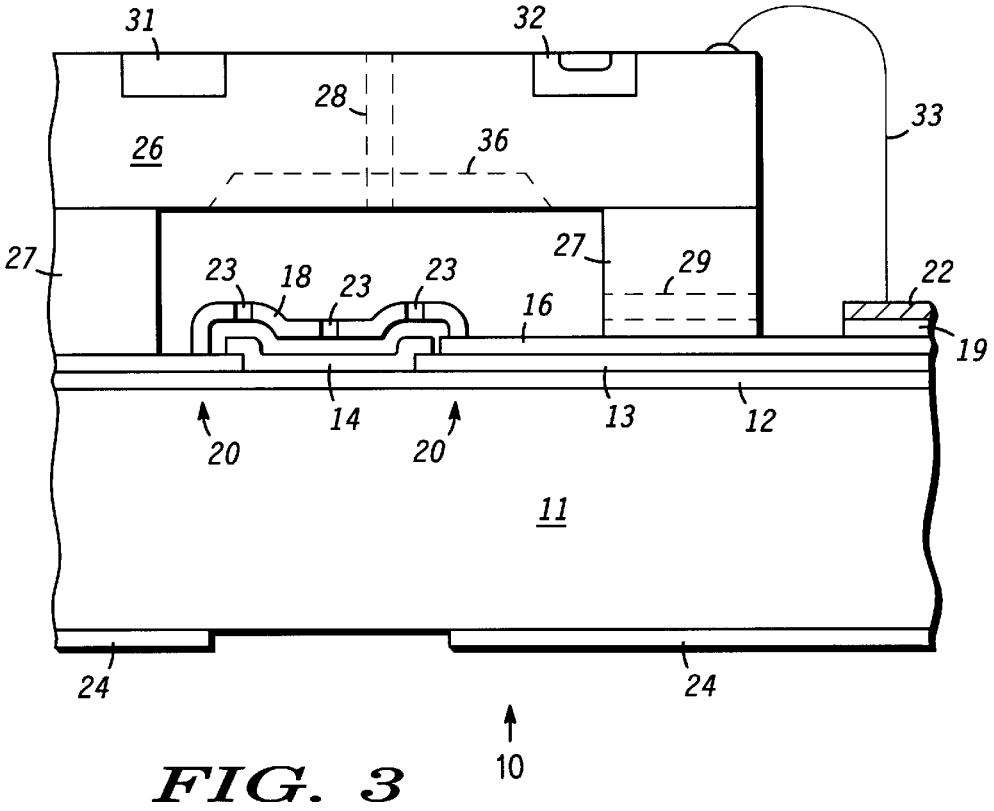

FIG. 3 illustrates an enlarged cross-sectional portion of microphone 10 at a subsequent manufacturing stage. Elements having the same reference numerals as FIGS. 1 and 2 are the same corresponding elements. Layers 21 and 17 (FIG. 2) are sacrificed or removed from microphone 10 thereby leaving a space between diaphragm 14 and plate 18 where layer 17 was positioned. Removing sacrificial layers 17 and 21 also leaves electrode 22 on contact 19 making electrical contact to runner 16. The etch used to remove layers 17 and 21 does not effect plate 18 or diaphragm 14. Additionally, layer 13 protects layer 12 during the removal of layers 17 and 21. A buffered hydrofluoric acid solution, a BOE etch, generally is utilized to remove layers 17 and 21. After removing layers 17 and 21, plate 18 remains attached to layer 13 with a portion of plate 18 overlying and aligned to diaphragm 14 and a space or gap between diaphragm 14 and plate 18 as shown in FIG. 3.

In order to protect microphone 10 during subsequent manufacturing operations, a cap 26 is fixedly attached to substrate 11. Cap 26 can be silicon or other material that is compatible with the manufacturing techniques utilized to form the other elements of microphone 10. Typically, cap 26 is silicon and is fixedly attached by use of a glass frit seal 27. Using a semiconductor material for cap 26 facilitates forming active semiconductor devices, such as a device 31 and a device 32, in cap 26. For example, device 31 and device 32 can be amplifiers that sense the capacitance change between diaphragm 14 and plate 18 and amplify the signal produced thereby. Devices 31 and 32 can be connected to plate 18 and diaphragm 14 via a bonding wire 33 or other electrical connections that are well known to those skilled in the art.

Utilizing a glass frit seal 27 facilitates attaching cap 26 at temperatures that are below temperatures that can destroy CMOS and other types of active semiconductor devices formed in cap 26. The material used for seal 27 only has to be heated to the glass transition temperature of the material, typically around 350 degrees Celsius, in order to perform the attachment. These temperatures are significantly below the 450 degrees Celsius that destroys most CMOS devices. Thus, the low temperature attachment facilitates the use of electronics in cap 26.

Pressure relief openings 28 and 29, shown by dashed lines, are formed to assist providing a flat response for microphone 10. Openings 28 and 29 relieve pressure created in the cavity underlying cap 26 to assist in ensuring that dampening holes 23 result in diaphragm 14 having a flat response up to the roll-off frequency. Openings 28 can be formed in cap 26 prior to attachment. Openings 29 can be formed in seal 27 when the material utilized for seal 27 is applied to substrate 11. The material utilized for seal 27 typically is applied by utilizing a silk screen process, thus, openings 29 can be a gap in the silk screen mask. It will be noted that in such a case, opening 29 extends the entire height or thickness of seal 27 and that the dashed outline shown in FIGS. 3 and 4 are for illustrative purposes and limited by the two dimensional drawing.

Additionally, a relief 36 can be formed in the back side of cap 26 to provide additional volume within the underlying cavity in order to ensure that microphone 10 has a flat response up to the roll-off frequency. It will be noted that relief 36 can be extended to the outside edge of cap 26 to provide another method of forming a pressure relief opening.

Figure 4:
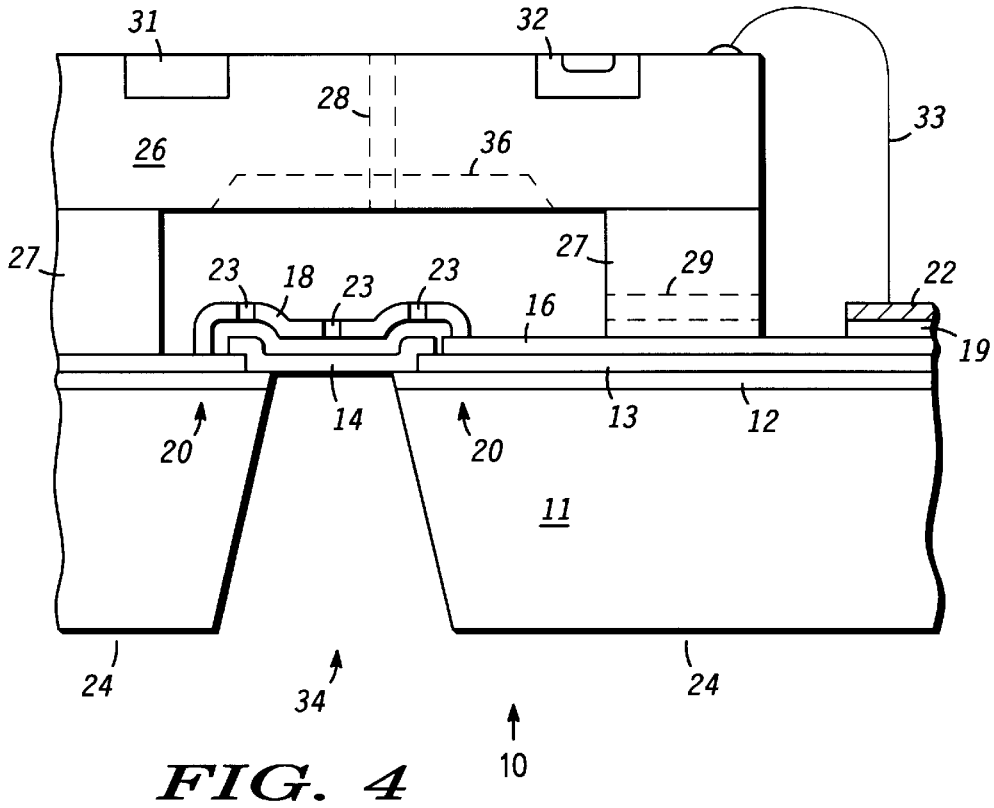
FIG. 4 illustrates an enlarged cross-sectional portion of a capacitive microphone in accordance with the present invention.

FIG. 4 illustrates microphone 10 after forming an atmospheric opening 34 through substrate 11 and removal of mask 24 (FIG. 3). An anisotropic etchant, such as tetramethylamonium hydroxide solution (TMAH etch), is utilized to etch opening 34 through substrate 11 while using mask 24 to protect other portions of substrate 11. The etch does not effect layer 12 which becomes an etch stop for forming opening 34. Thereafter, another BOE etch is utilized to etch through layer 12 during which the polysilicon of layer 14 functions as an etch stop. After the etching operations, diaphragm 14 is exposed to the external environment.

By now it should be noted that there has been provided a novel capacitive microphone structure and formation method. Utilizing a cap overlying the capacitive structure allows subsequent manufacturing operations such as wafer dicing, automated pick-and-place, and other operations without destroying microphone 10. Forming active devices in the cap facilitates a smaller die size than forming electronics in the substrate thereby allowing microphone 10 to be used in space critical applications such as hearing aids, etc. Utilizing polysilicon for the diaphragm facilitates doping and annealing operations that can be utilized to control the stress or stiffness of the diaphragm thereby the sensitivity of microphone 10. Utilizing polysilicon for the fixed capacitor plate results in manufacturing techniques that are compatible with the manufacturing techniques of the diaphragm thereby resulting in lower costs and more accurate control of the gap between the diaphragm and the top capacitor plate. Utilizing a frit glass seal to attach the cap permits sealing at low temperatures thereby facilitating the use of active semiconductors in the cap.

We claim:

1. A capacitive microphone comprising:

a substrate having a first surface, a second surface opposite to the first surface, and an atmospheric opening extending through the substrate from the second surface;

a doped polysilicon diaphragm of the capacitive microphone overlying the atmospheric opening;

a fixed capacitor plate formed from polysilicon wherein the fixed capacitor plate is aligned to the diaphragm; and a silicon cap overlying the diaphragm and the fixed capacitor plate, the silicon cap forming a cavity with the diaphragm and the fixed capacitor plate therein.

2. The capacitive microphone of claim 1 wherein the doped polysilicon and the fixed capacitor plate are annealed to establish a stress thereof.

3. The capacitive microphone of claim 1 further including a semiconductor device formed in the silicon cap.

4. The capacitive microphone of claim 1 further including the cap attached with frit glass.

5. A capacitive microphone comprising:

a silicon substrate having an atmospheric opening through the substrate;

an etch stop layer on the substrate, the etch stop layer having an opening aligned to the atmospheric opening;

a polysilicon diaphragm on the etch stop layer and overlying the atmospheric opening;

a polysilicon fixed plate overlying and spaced apart from the polysilicon diaphragm; and a cap overlying and spaced apart from the polysilicon fixed plate, the cap fixedly attached by a frit glass seal.

6. The capacitive microphone of claim 5 wherein the etch stop layer is silicon dioxide.

7. The capacitive microphone of claim 5 wherein the polysilicon diaphragm is doped polysilicon having a sensitivity of 0.1 to 20 mv/pascal.

8. The capacitive microphone of claim 5 wherein the polysilicon diaphragm has a resistivity of 10 to 1000 ohms/square.

9. The capacitive microphone of claim 5 further including damping openings through the polysilicon fixed plate.

10. The capacitive microphone of claim 5 further including pressure relief openings through the cap.

11. The capacitive microphone of claim 5 wherein the polysilicon diaphragm seals the atmospheric opening in the etch stop layer.

* * * * *